US009861141B1

(12) United States Patent
Liu

(10) Patent No.: US 9,861,141 B1
(45) Date of Patent: Jan. 9, 2018

(54) E-CIGARETTE

(71) Applicant: SHENZHEN BUDDY TECHNOLOGY DEVELOPMENT CO., LTD., Shenzhen (CN)

(72) Inventor: Xiang Liu, Shenzhen (CN)

(73) Assignee: SHENZHEN BUDDY TECHNOLOGY DEVELOPMENT CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/405,756

(22) Filed: Jan. 13, 2017

(30) Foreign Application Priority Data

Oct. 21, 2016 (CN) ..... 2016 2 1145022 U

(51) Int. Cl.
*A24F 47/00* (2006.01)
*B65D 43/02* (2006.01)

(52) U.S. Cl.
CPC ..... *A24F 47/008* (2013.01); *B65D 43/0225* (2013.01)

(58) Field of Classification Search
CPC . A24F 47/008; B65D 43/0225; H05B 3/0014; H05B 1/0244; H05B 3/40; F24H 1/0018; G01L 9/12
USPC ..... 131/329, 328
See application file for complete search history.

(56) References Cited

U.S. PATENT DOCUMENTS

D782,729 S 3/2017 Wright et al.
2015/0257447 A1* 9/2015 Sullivan ..... A24F 47/008 131/329
2016/0192708 A1* 7/2016 DeMeritt ..... H05B 3/40 131/329
2017/0071252 A1 3/2017 Liu
2017/0231281 A1* 8/2017 Hatton ..... A24F 47/008 131/328

FOREIGN PATENT DOCUMENTS

WO 2017045132 3/2017

* cited by examiner

*Primary Examiner* — Edwin A. Leon
(74) *Attorney, Agent, or Firm* — Hamre, Schumann, Mueller & Larson, P.C.

(57) ABSTRACT

Shown is an e-cigarette. The e-cigarette includes an atomizer and a battery rod component that are connected to each other. The atomizer includes a mouthpiece, an atomization component, and an e-liquid vial component. The mouthpiece is connected to the atomization component by means of the e-liquid vial component. The e-liquid vial component includes an e-liquid tube having an e-liquid chamber, an e-liquid isolation sheet is disposed inside the e-liquid tube at the end of the e-liquid chamber, a recess is disposed at the inner side of the e-liquid isolation sheet, and a gasket is sandwiched between the e-liquid isolation sheet and the e-liquid tube. A communication hole is provided on the gasket. The gasket divides the e-liquid chamber and the recess into two cavities that are different in size and are communicated by means of the communication hole. An e-liquid guide rope is inserted in the e-liquid isolation sheet, and the e-liquid guide rope is inserted in the recess of the e-liquid isolation sheet. The present invention has advantages of being capable of avoiding e-liquid leakage caused by violent shaking of the e-cigarette, having a good e-liquid leakage-proof effect, a simple structure, and a low cost, and being convenient to assemble.

8 Claims, 3 Drawing Sheets

E-CIGARETTE

BACKGROUND

Technical Field

The present invention relates to a structural improvement of an e-cigarette liquid vial component, and specifically relates to an e-cigarette.

Related Art

An e-cigarette that uses an e-liquid at present generally includes an atomizer and a battery rod component that are connected to each other. The atomizer of the e-cigarette generally includes an e-liquid tube having an e-liquid chamber. To transfer the e-liquid, generally an e-liquid guide rope is disposed between the e-liquid chamber and a heating component of the atomizer. However, during a transport and use process, the e-cigarette usually shakes violently, to cause the e-liquid inside the e-liquid chamber to violently impact the side of the heating component of the atomizer, thereby forming a relatively large pressure difference in the e-liquid in the e-liquid guide rope, and to cause the e-liquid to enter the heating component and an atomization chamber along the e-liquid guide rope, to further cause leakage of the e-liquid along an air passageway. Therefore, how to prevent an e-liquid from leaking when an e-cigarette shakes violently has become an urgent technical problem to be resolved.

SUMMARY

The problem to be resolved in the present invention: with respect to the problem in the prior art, an e-cigarette that is prepared by using an e-liquid vial component having a leakage-proof function and an atomizer is provided, the e-cigarette being capable of avoiding e-liquid leakage caused by violent shaking of the e-cigarette, having a good e-liquid leakage-proof effect, a simple structure, and a low cost, and being convenient to assemble.

To resolve the technical problem, the technical solutions adopted in the present invention are as follows:

The present invention provides an e-liquid vial component having a leakage-proof function, where the e-liquid vial component includes an e-liquid tube having an e-liquid chamber; an e-liquid isolation sheet is disposed inside the e-liquid tube at the end of the e-liquid chamber, a recess is disposed at the inner side of the e-liquid isolation sheet, and a gasket is sandwiched between the e-liquid isolation sheet and the e-liquid tube; a communication hole is provided on the gasket; the gasket divides the e-liquid chamber and the recess into two cavities that are different in size and are communicated by means of the communication hole; and an e-liquid guide rope is inserted in the e-liquid isolation sheet, and the e-liquid guide rope is inserted in the recess of the e-liquid isolation sheet.

Preferably, a screw cap made of metal is inserted in the e-liquid isolation sheet; an inner bore is provided at a middle section of the screw cap; the e-liquid guide rope is inserted in the inner bore of the screw cap; an external threaded section is disposed on the screw cap; and the screw cap is inserted in the e-liquid isolation sheet by means of the external threaded section and is in thread fit with the e-liquid isolation sheet.

Preferably, an e-liquid filling hole in communication with the e-liquid chamber is further provided on the e-liquid tube, and a silica gel plug is provided in the e-liquid filling hole.

Preferably, the gasket is made of stainless steel.

Preferably, an air guide channel that is independent from the e-liquid chamber is further provided inside the e-liquid tube.

Further, the present invention also provides an atomizer, including a mouthpiece, an atomization component, and an e-liquid vial component, where the mouthpiece is connected to the atomization component by means of the e-liquid vial component, and the e-liquid vial component is the foregoing e-liquid vial component having a leakage-proof function in the present invention.

Preferably, the atomization component includes a connecting rod, foamed nickel, a ceramic base, a heating component, a spacer, an e-liquid isolation material sheet, and an electrode component, where one end of the connecting rod is inserted in the e-liquid tube of the e-liquid vial component; the foamed nickel is in a tube shape and is inserted in an inner chamber of the connecting rod; the ceramic base is inserted in the foamed nickel; the heating component is secured on the ceramic base and is in contact with the e-liquid guide rope of the e-liquid vial component; the electrode component is arranged at the other end of the connecting rod; and the spacer and the e-liquid isolation material sheet are sequentially arranged inside the connecting rod and are located between the ceramic base and the electrode component.

Preferably, the connecting rod is made of metal; the electrode component includes a silica gel insulation sleeve and a thimble made of metal; the silica gel insulation sleeve is inserted and secured onto a top of the connecting rod, and the thimble is inserted and secured into the silica gel insulation sleeve.

Preferably, an external threaded rod is provided on the top of the connecting rod; and the silica gel insulation sleeve is inserted and secured into the external threaded rod.

Further, the present invention also provides an e-cigarette, including an atomizer and a battery rod component that are connected to each other, where the atomizer is the foregoing atomizer in the present invention.

The present invention has the following advantages: the e-liquid vial component having a leakage-proof function of the present invention includes an e-liquid tube having an e-liquid chamber, an e-liquid isolation sheet is disposed inside the e-liquid tube at the end of the e-liquid chamber, a recess is disposed at the inner side of the e-liquid isolation sheet, a gasket is sandwiched between the e-liquid isolation sheet and the e-liquid tube, a communication hole is provided on the gasket, the gasket divides the e-liquid chamber and the recess into two cavities that are different in size and are communicated by means of the communication hole, and an e-liquid guide rope is inserted in the e-liquid isolation sheet, and the e-liquid guide rope is inserted in the recess of the e-liquid isolation sheet; therefore impact on the e-liquid inside the e-liquid chamber is mostly blocked by the gasket, and thus e-liquid leakage caused by violent shaking of e-cigarette can be avoided; and therefore the present invention has advantages of having a good e-liquid leakage-proof effect, a simple structure, and a low cost, and being convenient to assemble.

DESCRIPTION OF THE REFERENTIAL NUMERALS

1. e-liquid tube; 10. e-liquid chamber; 11. e-liquid filling hole; 12. air guide channel; 2. e-liquid isolation sheet; 21. recess; 22. screw cap; 3. e-liquid guide rope; 4. gasket; 41. communication hole; 5. silica gel plug; 6.

mouthpiece; 7. atomization component; 71. connecting rod; 711. external threaded rod; 72. foamed nickel; 73. ceramic base; 74. heating component; 75. spacer; 76. e-liquid isolation material sheet; 77. electrode component; 771. silica gel insulation sleeve; and 772. Thimble.

DETAILED DESCRIPTION

Figure 1:
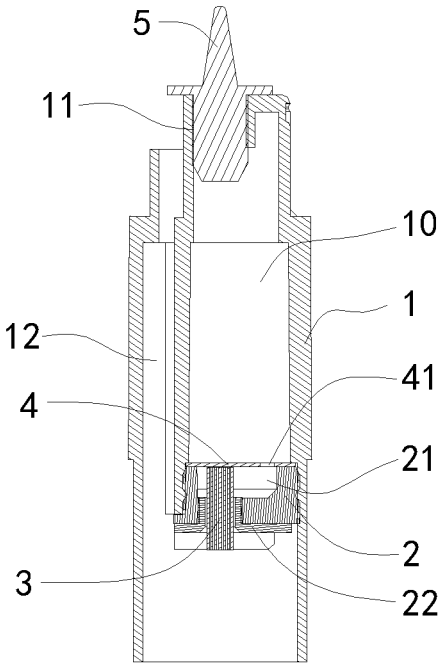
FIG. 1 is a schematic exploded structural diagram of an e-liquid vial component according to Embodiment 1 of the present invention.
Figure 2:
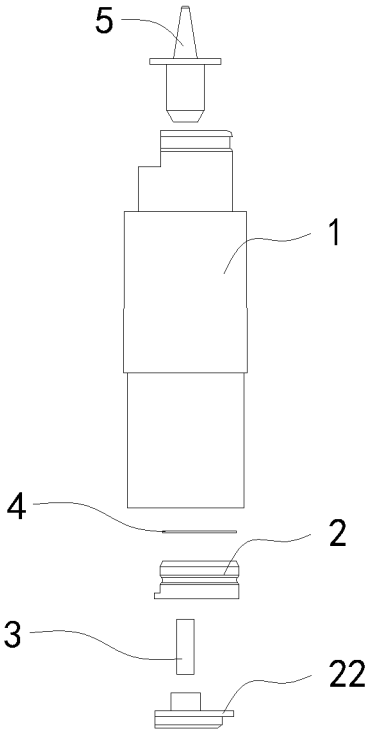
FIG. 2 is a schematic front exploded structural diagram of the e-liquid vial component according to Embodiment 1 of the present invention.

Embodiment 1:

As shown in FIG. 1 and FIG. 2, an e-liquid vial component having a leakage-proof function in this embodiment includes an e-liquid tube 1 having an e-liquid chamber 10. An e-liquid isolation sheet 2 is disposed inside the e-liquid tube 1 at the end of the e-liquid chamber 10, a recess 21 is disposed at the inner side of the e-liquid isolation sheet 2, and a gasket 4 is sandwiched between the e-liquid isolation sheet 2 and the e-liquid tube 1. A communication hole 41 is provided on the gasket 4. The gasket 4 divides the e-liquid chamber 10 and the recess 21 into two cavities that are different in size and are communicated by means of the communication hole 41. An e-liquid guide rope 3 is inserted in the e-liquid isolation sheet 2, and the e-liquid guide rope 3 is inserted in the recess 21 of the e-liquid isolation sheet 2. In the e-liquid vial component having a leakage-proof function in this embodiment, the gasket 4 divides the e-liquid chamber 10 and the recess 21 into two cavities that are different in size and are communicated to each other by means of the communication hole 41, the e-liquid guide rope 3 is inserted in the recess 21 of the e-liquid isolation sheet 2 and therefore impact on the e-liquid inside the e-liquid chamber 10 is mostly blocked by the gasket 4 when the e-cigarette shakes violently.

Therefore, e-liquid leakage caused by violent shaking of the e-cigarette can be avoided. The present invention has advantages of having a good e-liquid leakage-proof effect, a simple structure, and a low cost, and being convenient to assemble.

As shown in FIG. 1 and FIG. 2, a screw cap 22 made of metal is inserted in the e-liquid isolation sheet 2. An inner bore is provided at a middle section of the screw cap 22. The e-liquid guide rope 3 is inserted in the inner bore of the screw cap 22. An external threaded section is disposed on the screw cap 22. The screw cap 22 is inserted in the e-liquid isolation sheet 2 by means of the external threaded section 2 and is in thread fit with the e-liquid isolation sheet 2. By means of the structure, in one aspect, reliable sealing (thread sealing) and connection between the e-liquid isolation sheet 2 and the screw cap 22 can be guaranteed; and in another aspect, the structure of the e-liquid guide rope 3 can be effectively protected, and deformation of e-liquid guide rope 3, which influences an e-liquid guide effect, is avoided.

As shown in FIG. 1 and FIG. 2, an e-liquid filling hole 11 that is in communication with the e-liquid chamber 10 is further provided on the e-liquid tube 1. A silica gel plug 5 is provided in the e-liquid filling hole 11. By means of the structure, recycling of the e-liquid vial component can be implemented.

As shown in FIG. 1 and FIG. 2, the gasket 4 is made of stainless steel, has stable physical and chemical properties, and is easy and convenient to manufacture.

As shown in FIG. 1 and FIG. 2, an air guide channel 12 that is independent from the e-liquid chamber 10 is further provided inside the e-liquid tube 1.

Figure 3:
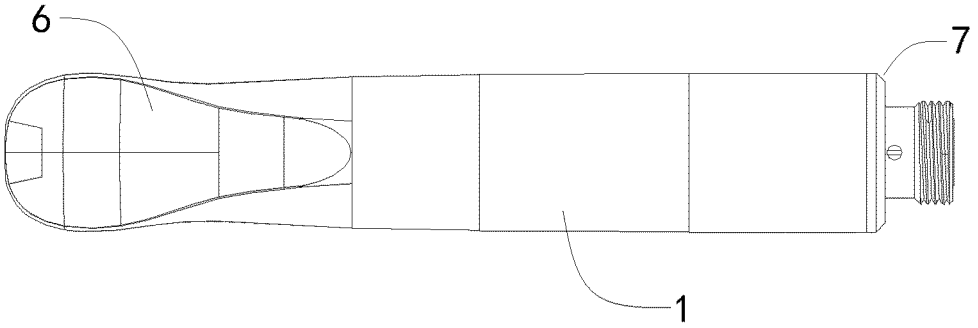
FIG. 3 is a schematic front structural diagram of an atomizer according to Embodiment 1 of the present invention.
Figure 4:
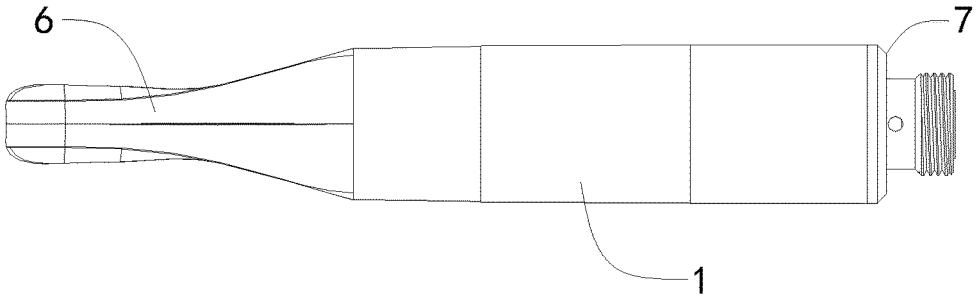
FIG. 4 is a schematic side structural diagram of the atomizer according to Embodiment 1 of the present invention.
Figure 5:
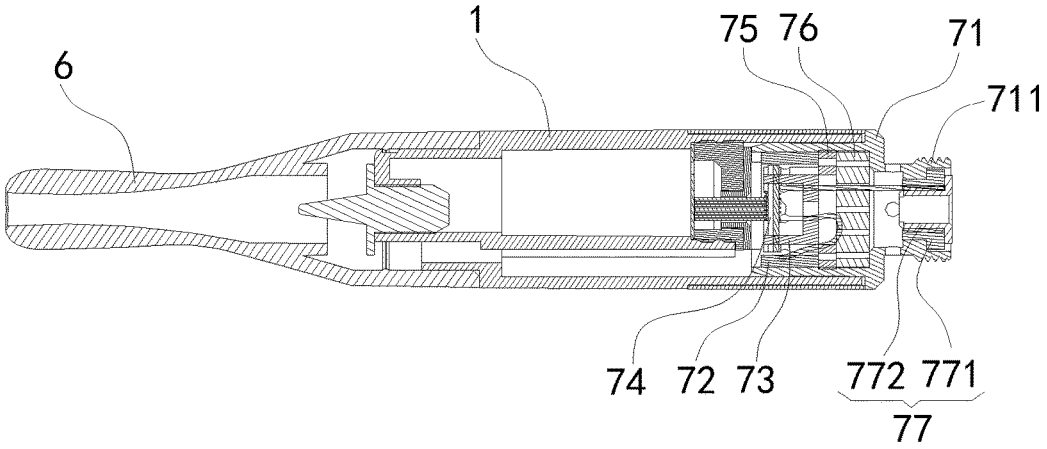
FIG. 5 is a schematic exploded structural diagram of the atomizer according to Embodiment 1 of the present invention.

As shown in FIG. 3, FIG. 4, and FIG. 5, the atomizer in this embodiment includes a mouthpiece 6, an atomization component 7, and an e-liquid vial component. The mouthpiece 6 is connected to the atomization component 7 by means of the e-liquid vial component. The e-liquid vial component is the foregoing e-liquid vial component having a leakage-proof function in this embodiment.

As shown in FIG. 3, FIG. 4, and FIG. 5, the atomization component 7 includes a connecting rod 71, foamed nickel 72, a ceramic base 73, a heating component 74, a spacer 75, an e-liquid isolation material sheet 76, and an electrode component 77. One end of the connecting rod 71 is inserted in the e-liquid tube 1 of the e-liquid vial component. The foamed nickel 72 is in a tube shape and is inserted in an inner chamber of the connecting rod 71. The ceramic base 73 is inserted in the foamed nickel 72. The heating component 74 is secured on the ceramic base 73 and is in contact with the e-liquid guide rope 3 of the e-liquid vial component. The electrode component 77 is arranged at the other end of the connecting rod 71. The spacer 75 and the e-liquid isolation material sheet 76 are sequentially arranged inside the connecting rod 71 and are located between the ceramic base 73 and the electrode component 77.

In this embodiment, the spacer 75 is made of a silica gel. A first through hole arranged in an axial direction is provided in a middle section of the spacer 75, and a plurality of second through holes arranged in the axial direction is provided on peripheries of the first through hole on the spacer 75. The first through hole is greater than the second through hole. The e-liquid isolation material sheet 76 is made of an oleophobic material, and a plurality of third through holes arranged in the axial direction is provided on the e-liquid isolation material sheet 76. By means of the structure, the ventilation and e-liquid isolation properties of the spacer 75 and the e-liquid isolation material sheet 76 can be guaranteed, thereby preventing the e-liquid from polluting the electrode component 77 or even leaking from the electrode component 77.

As shown in FIG. 3, FIG. 4, and FIG. 5, the connecting rod 71 is made of metal. The electrode component 77 includes a silica gel insulation sleeve 771 and a thimble 772 made of metal. The silica gel insulation sleeve 771 is inserted and secured onto a top of the connecting rod 71, and the thimble 772 is inserted and secured into the silica gel insulation sleeve 771. An external threaded rod 711 is provided on the top of the connecting rod 71. The silica gel insulation sleeve 771 is inserted and secured into the external threaded rod 711. The thread connection is secure and reliable, and can ensure the stability of electrical connection of the electrode component 77.

The atomizer of this embodiment may further be integrated into an e-cigarette for selling. An e-cigarette integrated with the atomizer of this embodiment includes an atomizer and a battery rod component that are connected to each other.

Figure 6:
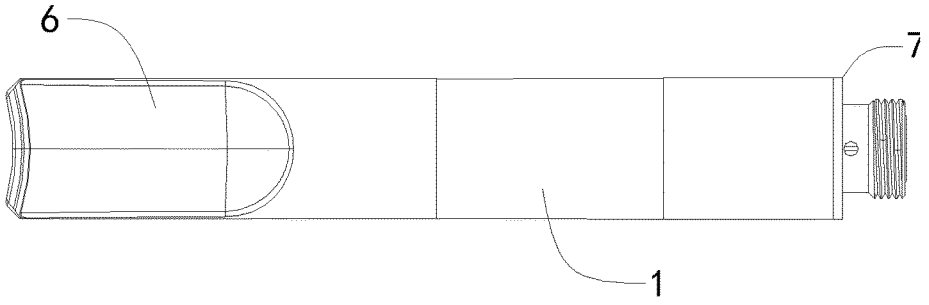
FIG. 6 is a schematic front structural diagram of an atomizer according to Embodiment 2 of the present invention.
Figure 7:
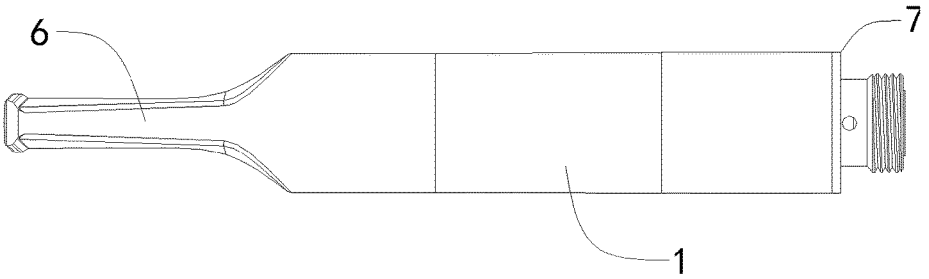
FIG. 7 is a schematic side structural diagram of the atomizer according to Embodiment 2 of the present invention.
Figure 8:
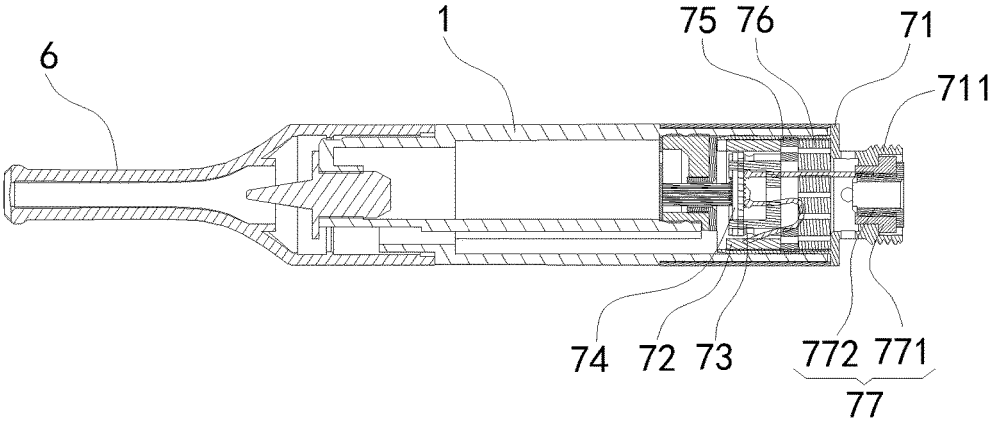
FIG. 8 is a schematic exploded structural diagram of the atomizer according to Embodiment 2 of the present invention.

Embodiment 2:

An e-liquid vial component having a leakage-proof function of this embodiment is fully the same as that of Embodiment 1, and a main difference of Embodiment 2 is that the structure of an atomizer in this embodiment is different. In the atomizer of Embodiment 1, the mouthpiece 6 is in a mouthpiece shape, and a chamfer is provided at an edge of the connecting rod 71. As shown in FIG. 6, FIG. 7, and FIG. 8, the mouthpiece 6 in the atomizer of this embodiment is in a flat shape, and no chamber is provided at an edge of the connecting rod 71. The internal structure of the atomizer is the same as that of Embodiment 1, which is not described in detail herein.

The above is only preferable implementation manners of the present invention, and the protection scope of the present invention is not limited to the embodiments. Any technical solution within the concept of the present invention shall fall within the protection scope of the present invention. It should be noted that for a person skilled in the art of ordinary skill in the art, the alternations and modifications made without departing from the principles of the present invention shall also fall within the protection scope of the present invention.

What is claimed is:

1. An e-cigarette, comprising an atomizer and a battery rod component that are connected to each other, the atomizer comprising a mouthpiece (6), an atomization component (7) for atomizing, and an e-liquid vial component, the mouthpiece (6) being connected to the atomization component (7) by means of the e-liquid vial component, wherein the e-liquid vial component is an e-liquid vial component having a leakage-proof function, and comprises an e-liquid tube (1) having an e-liquid chamber (10); an e-liquid isolation sheet (2) is disposed inside the e-liquid tube (1) at the end of the e-liquid chamber (10), a recess (21) is disposed at the inner side of the e-liquid isolation sheet (2), and a gasket (4) is sandwiched between the e-liquid isolation sheet (2) and the e-liquid tube (1); a communication hole (41) is provided on the gasket (4); the gasket (4) divides the e-liquid chamber (10) and the recess (21) into two cavities that are different in size and are communicated by means of the communication hole (41); and an e-liquid guide rope (3) is inserted in the e-liquid isolation sheet (2), and the e-liquid guide rope (3) is inserted in the recess (21) of the e-liquid isolation sheet (2).

2. The e-cigarette according to claim 1, wherein a screw cap (22) made of metal is inserted in the e-liquid isolation sheet (2); an inner bore is provided at a middle section of the screw cap (22); the e-liquid guide rope (3) is inserted in the inner bore of the screw cap (22); an external threaded section is disposed on the screw cap (22); and the screw cap (22) is inserted in the e-liquid isolation sheet (2) by means of the external threaded section and is in thread fit with the e-liquid isolation sheet (2).

3. The e-cigarette according to claim 1, wherein an e-liquid filling hole (11) in communication with the e-liquid chamber (10) is further provided on the e-liquid tube (1), and a silica gel plug (5) is provided in the e-liquid filling hole (11).

4. The e-cigarette according to claim 1, wherein the gasket (4) is made of stainless steel.

5. The e-cigarette according to claim 1, wherein an air guide channel (12) that is independent from the e-liquid chamber (10) is further provided inside the e-liquid tube (1).

6. The e-cigarette according to claim 1, wherein the atomization component (7) comprises a connecting rod (71), foamed nickel (72), a ceramic base (73), a heating component (74), a spacer (75), an e-liquid isolation material sheet (76), and an electrode component (77), wherein one end of the connecting rod (71) is inserted in the e-liquid tube (1) of the e-liquid vial component; the foamed nickel (72) is in a tube shape and is inserted in an inner chamber of the connecting rod (71); the ceramic base (73) is inserted in the foamed nickel (72); the heating component (74) is secured on the ceramic base (73) and is in contact with the e-liquid guide rope (3) of the e-liquid vial component; the electrode component (77) is arranged at the other end of the connecting rod (71); and the spacer (75) and the e-liquid isolation material sheet (76) are sequentially arranged inside the connecting rod (71) and are located between the ceramic base (73) and the electrode component (77).

7. The e-cigarette according to claim 6, wherein the connecting rod (71) is made of metal; the electrode component (77) comprises a silica gel insulation sleeve (771) and a thimble (772) made of metal; the silica gel insulation sleeve (771) is inserted and secured onto a top of the connecting rod (71); and the thimble (772) is inserted and secured into the silica gel insulation sleeve (771).

8. The e-cigarette according to claim 7, wherein an external threaded rod (711) is provided on the top of the connecting rod (71); and the silica gel insulation sleeve (771) is inserted and secured into the external threaded rod (711).

* * * * *